United States Patent [19]

Warlick

[11] 4,331,265

[45] May 25, 1982

[54] TUBE SQUEEZER-DISPENSER WITH DRIP PREVENTION

[76] Inventor: Harley A. Warlick, Rte. 2, Bostic, N.C. 28018

[21] Appl. No.: 223,136

[22] Filed: Jan. 7, 1981

[51] Int. Cl.[3] ..... B65D 35/28

[52] U.S. Cl. ..... 222/101

[58] Field of Search ..... 141/360, 361, 362; 222/96, 101, 102, 105

[56] References Cited

U.S. PATENT DOCUMENTS

| | | | |
|---|---|---|---|
| 1,514,018 | 11/1924 | Sharpe . | |
| 1,590,626 | 6/1926 | Highley . | |
| 2,056,422 | 10/1936 | Crossley . | |
| 3,417,902 | 12/1968 | Mirka . | |
| 4,019,655 | 4/1977 | Moeller | 222/96 |

FOREIGN PATENT DOCUMENTS

| | | | |
|---|---|---|---|
| 969513 | 6/1975 | Canada | 222/91 |
| 602639 | 5/1948 | United Kingdom | 222/102 |

*Primary Examiner*—David A. Scherbel
*Attorney, Agent, or Firm*—W. Thad Adams, III

[57] ABSTRACT

The dispenser progressively empties a tube from one end by applying pressure to the other end. The dispenser comprises a support on which the tube rests. A handle is pivotally mounted on the support and has a range of reciprocating movement between first and second pre-determined points for applying an increment of pressure to one end of the tube. A ratchet is connected to the handle and permits the roller to move incrementally forward against the tube exerting pressure thereon during each reciprocation. As the handle moves between the first and second pre-determined points, it moves to an intermediate point defined relative to the point where the handle is pivotally mounted on the support and beyond the point to an over-center position where the roller releases sufficient pressure on the contents of the tube to prevent residual emptying or dripping.

4 Claims, 6 Drawing Figures

TUBE SQUEEZER-DISPENSER WITH DRIP PREVENTION

BACKGROUND OF THE INVENTION

This invention relates to a tube dispenser used for progressively emptying a tube from one end by applying pressure to the contents of the tube from the other end. The tube may be a soft, flexible tube such as holds toothpaste or shampoo, or may be a tube comprised of a rigid cylinder having a moveable piston therein, such as is used to dispense caulking or glazing compound and the like.

Whether dispensing from a flexible or rigid tube, one problem often encountered in connection with the use of a mechanical tube dispenser or caulking gun is the tendency of the tube to continue to dispense material after each stroke of the dispenser. This is usually caused by an "over-kill" pumping or moving of the dispenser handle in an effort to speed the dispensing of the material from the tube. After the desired amount of material has been dispensed, the pressure inside the tube has not yet equalized so it continues to dispense.

So far as is known, only one type of device—a trigger-type caulking gun—is available which will prevent residual dripping of materials housed in rigid tubes. This involves the incorporation into the caulking gun of an elongate plunger in axial alignment with the tube and having a circular plate on one end which fits into the hollow of the tube and bears against the moveable piston. One side of the plunger is provided with ratchet teeth which correspondingly engage with a ratcheting member connected to the trigger. During each reciprocation of the trigger, the ratchet forces the plunger slightly further into the tube. To prevent dripping and to stop the flow precisely when desired, the plunger is rotated so that the ratchet teeth are moved out of mating engagement with the trigger and pressure on the piston is released. The disadvantage is, of course, that a completely separate movement apart from the actuation of the trigger is required to stop the flow when necessary, followed by a movement of the plunger back into mating engagement with the trigger each time continued dispensing from the tube is desired. Applicant is not aware of any prior art device which permits precise control of dispensing from rigid tubes without the requirement of a completely separate "disconnecting-connecting" movement, as described above.

Likewise, applicant is aware of no prior art device which permits the same precise metering of materials from flexible tubes. Attempts have been made to correct these problems, but without apparent success. For example, the Mirka U.S. Pat. No. 3,417,902 discloses a rather complicated device which utilizes a slidable bar gear operated by a cam which drives a roller which squeezes a tube. Through a complicated mechanism, a plunger automatically interrupts the flow of paste through the discharge port at the bottom end of the dispenser.

SUMMARY OF THE INVENTION

Accordingly, it is the object of this invention to provide a tube dispenser for progressively emptying a tube from one end by applying pressure to the contents of the tube from the other, and permitting the release of sufficient pressure on the contents during a reciprocation of actuating means to prevent residual emptying or dripping from the tube, thereby permitting a precisely metered flow of the contents. This and other objects and advantages of the present invention are achieved in the preferred embodiment set forth herein which pertains to a dispenser for emptying flexible, or collapsible, tubes. However, the invention described and claimed herein is equally adaptable to use with a rigid tube of the type used to apply caulking, as described above.

The preferred embodiment comprises a support for receiving and supporting a tube against longitudinal relative movement. A handle is pivotally mounted on the support and has a range of reciprocating movement between first and second pre-determined points for applying an increment of pressure to one end of the tube. Ratchet means are operatively connected to the handle and comprise a pair of parallel, spaced-apart and longitudinally extending elongate members having a roller mounted transversely thereon for limited movement from the closed end of the tube towards the open end of the tube. The ratchet means also include means wherein during each reciprocation of the handle the roller is incrementally moved forward against the tube thereby exerting pressure thereon. The roller is maintained in this position during movement of the handle to a point defined relative to the pivot point of the handle on the support, and beyond the pivot point to an over-center position where the roller releases sufficient pressure on the contents of the tube to prevent residual emptying or dripping after each successive reciprocating movement of the handle. As a result, a precisely metered flow of the contents from the tube is permitted.

Preferably, each of the pair of spaced-apart and longitudinally extending members is provided with ratchet teeth along one axially aligned surface thereof and angle towards the direction of forward movement of the roller. The roller is mounted on an axle for free relative rotational movement. The axle includes a pair of collars which extend axially outwardly beyond the opposing end edges of the roller. Each collar is provided with apertures for being slidably moveable along the spaced-apart members.

BRIEF DESCRIPTION OF THE DRAWINGS

Some of the objects of the invention having been set forth above, other objects and advantages will appear as the description of the invention proceeds, when taken in conjunction with the following drawings in which.

DESCRIPTION OF THE PREFERRED EMBODIMENT

Figure 1:
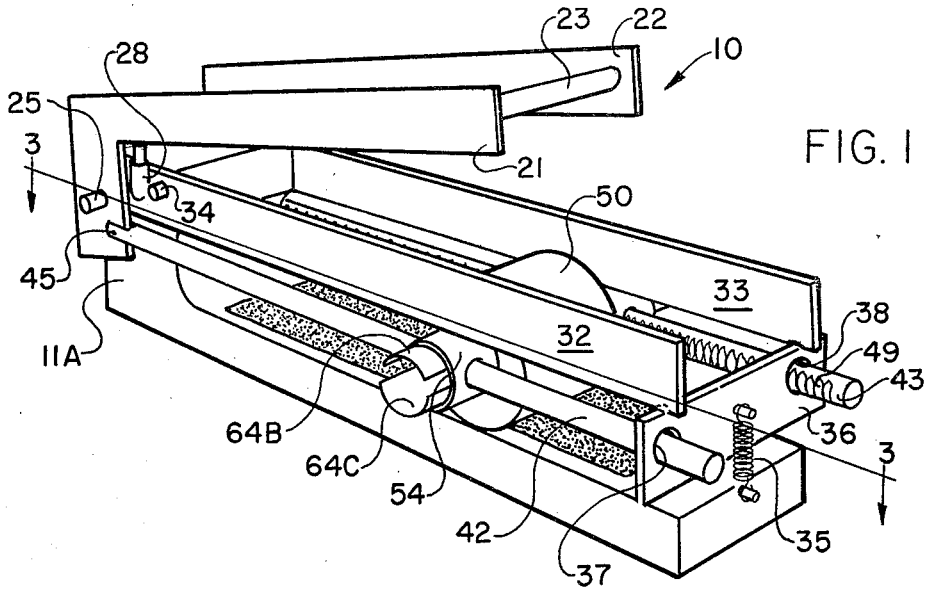
FIG. 1 is a perspective view of a preferred embodiment of the tube dispenser according to this invention.
Figure 2:
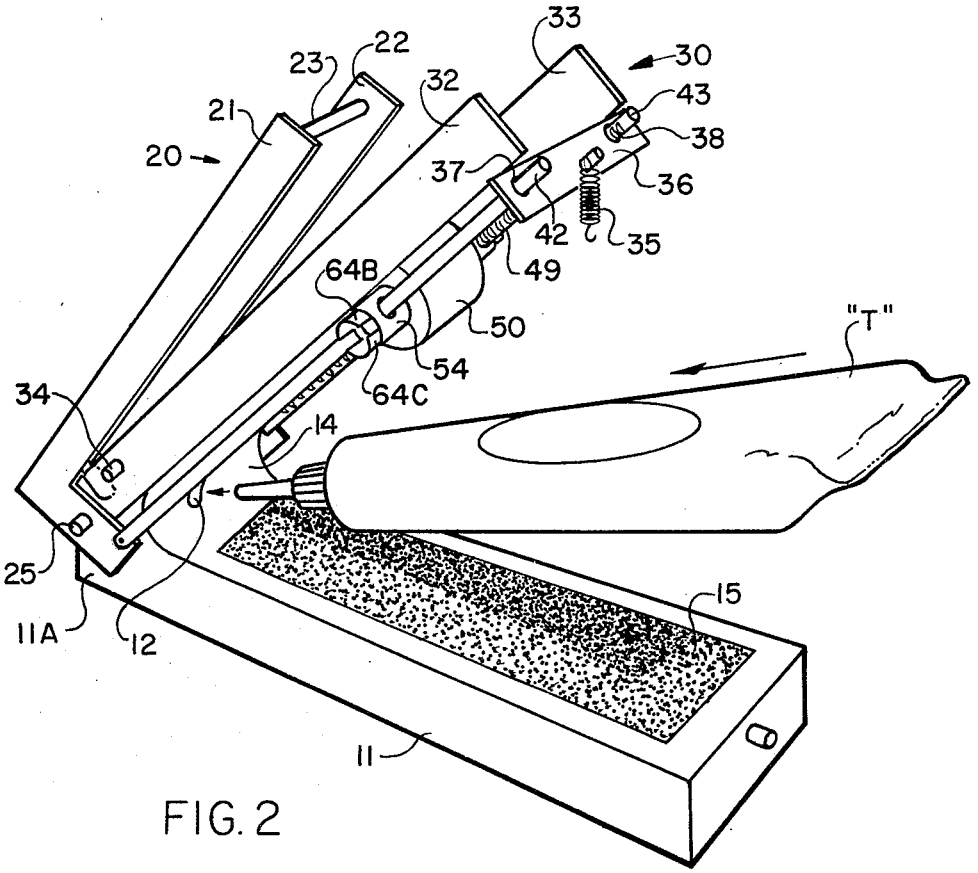
FIG. 2 is a perspective view of a preferred embodiment of a tube dispenser according to the present invention in open position for being loaded with a tube.

Referring now specifically to the drawings, a tube dispenser according to one embodiment of the present invention is indicated broadly at reference numeral 10 of FIGS. 1 and 2. The tube dispenser comprises a support 11 on which a tube "T" is placed. The support 11 includes a raised, vertically projecting wall 11A on one end. Wall 11A is provided with a through aperture 12 in which the tube "T" is positioned. The manner in which the tube is loaded in the tube dispenser 10 is illustrated in FIG. 2. The forward shoulders of the tube are restrained against forward movement by a concave face of wall 11A. Preferably, the upper surface of the support 11 is at least partially covered with a sheet-like material 15 having a tacky or rough surface to frictionally engage the tube and prevent slippage or side-to-side movement as the dispenser is operated.

Attached to the wall 11A of the support member 11 for pivotal movement is a handle 20. The handle 20 is comprised of two substantially L-shaped arms 21 and 22. Arms 21 and 22 are maintained in spaced-apart relation by being positioned on the opposing outer surfaces of wall 11A. Arms 21 and 22 pivot about a point defined by a pin 25 which extends through wall 11A and through suitably sized holes properly positioned in arms 21 and 22, as shown in FIG. 2. Arms 21 and 22 are maintained in spaced-apart relation adjacent their respective free ends by means of a spacing brace 23.

Handle 20 is normally maintained in an upward, spaced-apart relation from the support 11 by biasing means, comprising a compression spring 28 mounted on the upper surface of wall 11A beneath arm 21 of handle 20. The compression spring pushes upwardly on the downwardly facing edge of arm 21, normally urging the handle 20 upwardly.

Ratchet means, broadly indicated at reference numeral 30, are operatively connected to handle 20 and comprise a pair of parallel, spaced-apart and longitudinally extending braces 32 and 33. Braces 32 and 33 are pivoted by pin 34 to wall 11A. As is illustrated in FIG. 2, the ratchet means assembly 30 can be pivoted upwardly in order to permit insertion of a tube into the dispenser. Braces 32 and 33 are maintained in laterally spaced-apart relation on their free ends by means of a metal spacing plate 36 secured thereto, as shown in FIGS. 1 and 2.

Ratchet means 30 is held in a substantially parallel position to the support 11 during operation by means of a spring 35 which is connected to the metal spacing plate 36 and the adjacent end of support 11.

Figure 3:
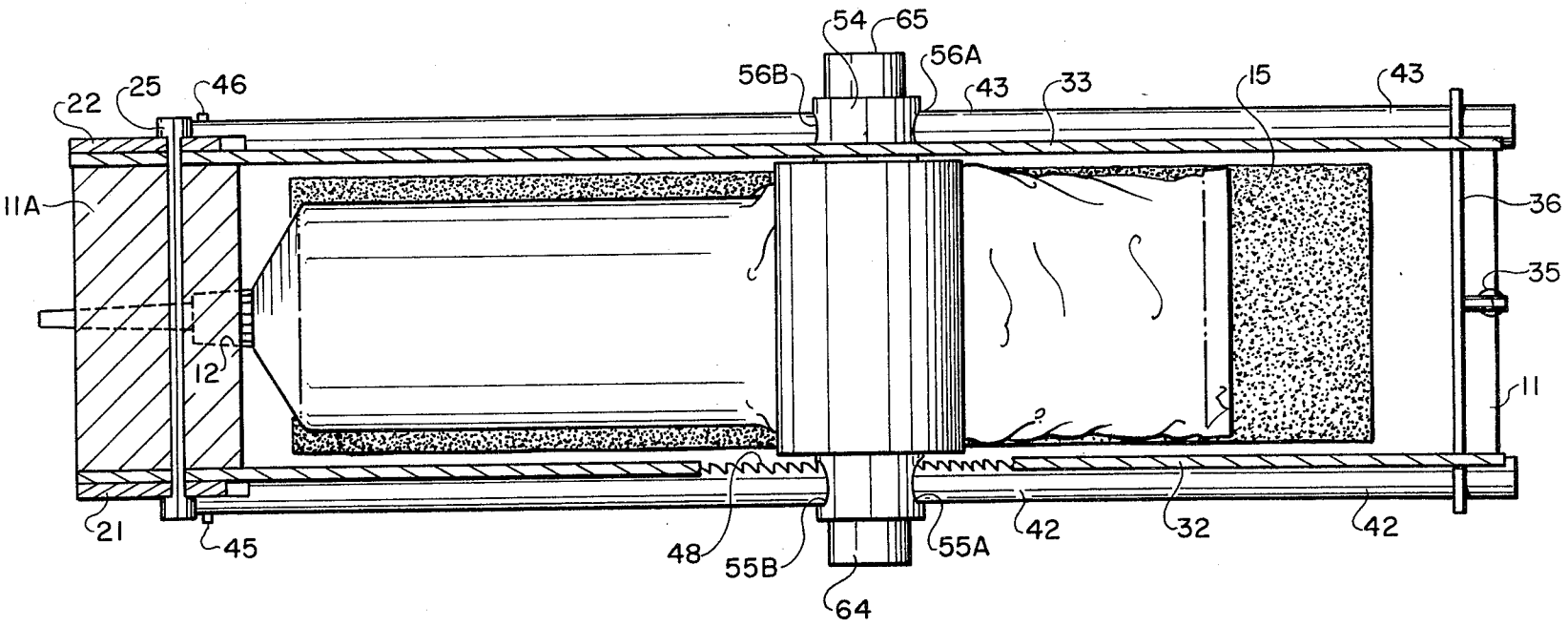
FIG. 3 is a cross-sectional view taken substantially along lines 3—3 of FIG. 1.

The metal spacing plate 36 is provided with apertures 37 and 38, respectively, on its opposing ends. As is shown in FIG. 1, rails 42 and 43 are positioned adjacent one end thereof in apertures 37 and 38, respectively, for free sliding movement therein. As is shown in FIG. 3, rails 42 and 43 extend the length of support 11 and are pivotally connected to arms 21 and 22, respectively, by pins 45 and 46, respectively. Ratchet teeth, collectively referred to as reference numeral 48, are formed into the inwardly facing axially extending side of rail 42. Ratchet teeth 49 are likewise formed into the inwardly facing axially extending side of rail 43. Therefore, ratchet teeth 48 and 49 face inwardly towards each other, as shown in FIG. 5, and are articulated in the forward direction along the support 11 towards the support wall 11A.

Mounted for ratcheting movement along the opposing rails 42 and 43 is a roller assembly comprising a rubber roller 50 having an axially extending through bore 51. An axle 54 is mounted in bore 51 of roller 50. Axle 54 has a first pair of diametrically opposed holes 55A and 55B adjacent one end thereof, and a second pair of diametrically opposed holes 56A and 56B adjacent its opposing end. As is shown in FIG. 3, rails 42 and 43 are positioned through holes 55A and 55B, and 56A and 56B, respectively. Thus, axle 54 is mounted for sliding movement along rails 42 and 43, but is prevented from rotating thereon. Axle 54 is slightly undersized relative to bore 51 in roller 50 so that roller 50 may rotate relative to axle 54 as the axle 54 moves along rails 42 and 43.

Figure 5:
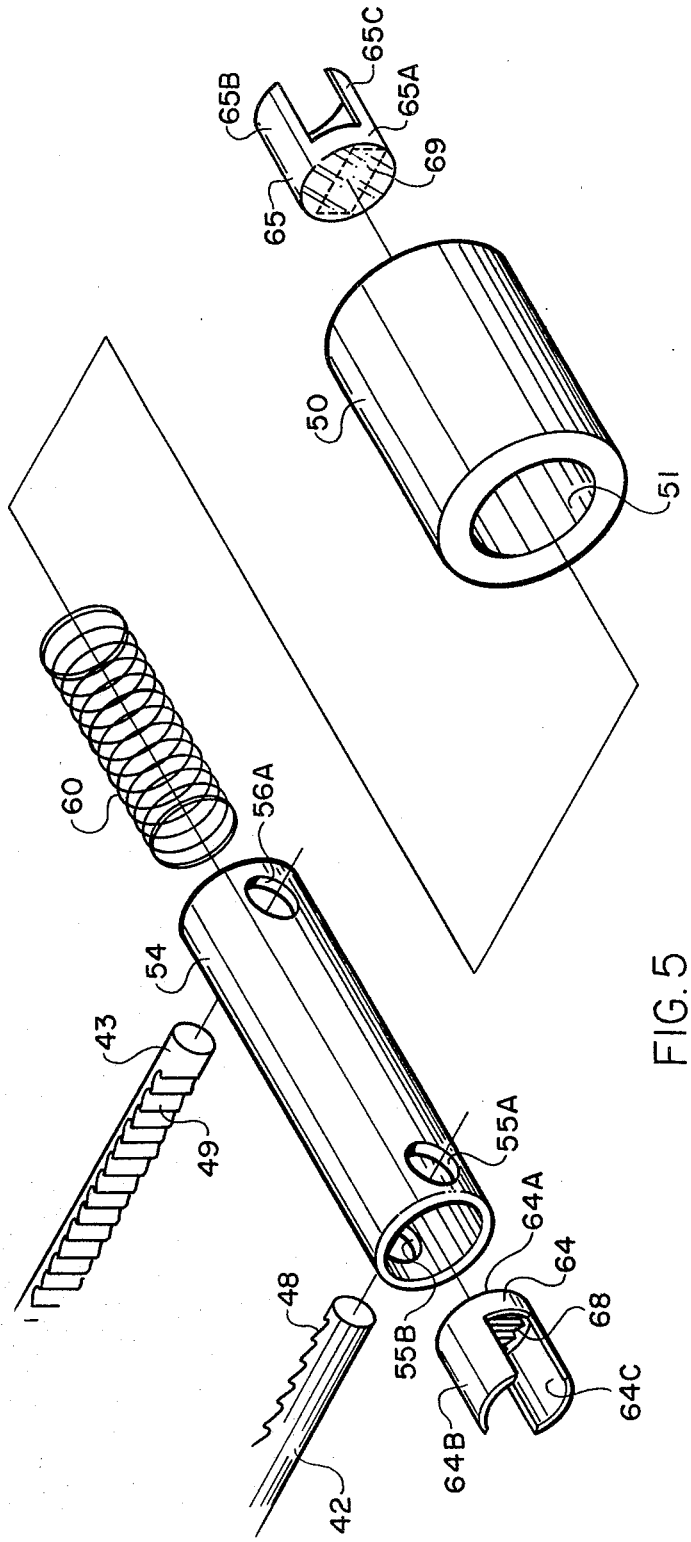
FIG. 5 is a fragmentary exploded view of part of the ratchet mechanism.

Referring to FIG. 5, a coil spring 60 is positioned within axle 54 intermediate pairs of holes 55A and 55B, and 56A and 56B. A collar 64, having a cylindrical body portion 64A and integrally formed, outwardly projecting legs 64B and 64C is positioned within the axle 54.

Figure 6:
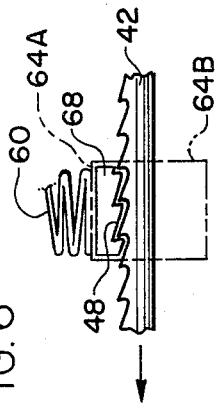
FIG. 6 is an enlarged cross-sectional view of part of the ratchet mechanism.

As is shown in FIG. 6, a short section of ratchet teeth 68 is fixedly secured to the outwardly facing surface of body portion 64A of collar 64. Ratchet teeth 68 are rearwardly facing and thus matingly engage with the forwardly facing ratchet teeth 48.

In the same manner as described above, a collar 65, having a cylindrical body portion 65A and integrally formed, outwardly projecting legs 65B and 65C, is positioned within axle 54 in diametrical opposition to collar 64. A short section of rearwardly directed ratchet teeth 69 is fixedly secured to the outwardly facing surface of the body portion 65A of collar 65. The rearwardly directed ratchet teeth 69 matingly engage with the forwardly directed ratchet teeth 49 on rail 43.

As indicated by the exploded view in FIG. 6, collars 64 and 65 are each positioned so that the slots, formed by the spaces between their respective legs project outwardly and straddle rails 42 and 43, respectively. A coil spring 60 is positioned within the axle 54 intermediate collars 64 and 65, urging the collars, and the attached ratchet teeth, outwardly into engagement with the ratchet teeth on the respective rails 42 and 43.

As is shown in FIG. 6, forward movement of rails 42 and 43 moves the roller 50 forward along the length of support 11. Conversely, rearward movement of rails 42 and 43 permits the roller 50 to remain stationary since ratchet teeth 48 and 49 engage the spring-loaded ratchet teeth 68 and 69 on collars 64 and 65 at an oblique angle and slide past.

Figure 4:
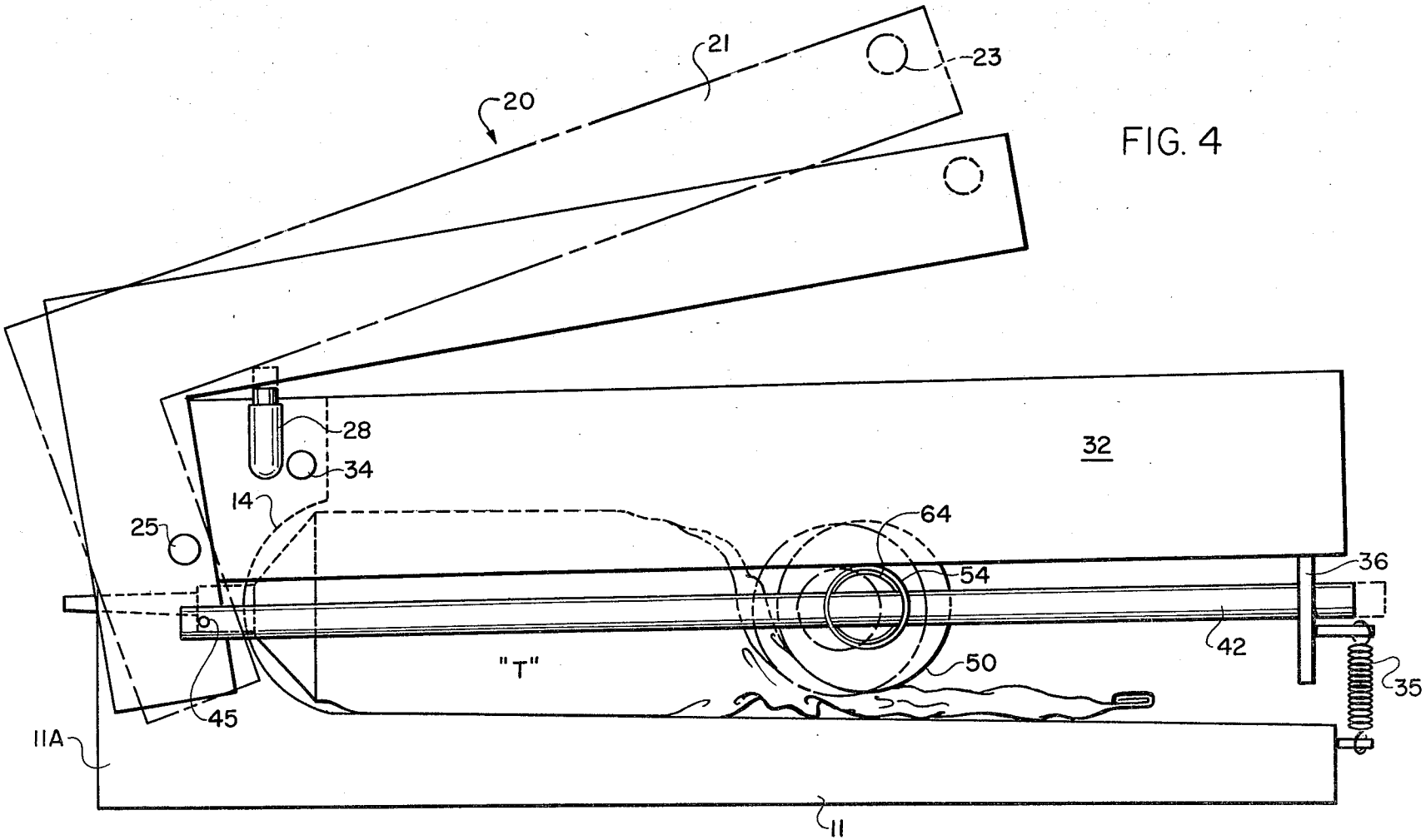
FIG. 4 is a side elevational view of the tube dispenser according to this invention and showing the manner in which the handle backs the roller away from the pressure engagement with the tube.

Referring to FIG. 4, handle 20 is shown in two positions, one in solid lines and the other in phantom lines. As is evident from the drawings and the above description, handle 20 has a range of reciprocating, back and forth movement between first and second pre-determined positions. Each reciprocation of handle 20 is begun by pushing downwardly thereby overcoming the upward force of the compression spring 28. As handle 20 moves downwardly, rails 42 and 43 are pulled forward relative to support 11. Ratchet teeth 48 and 49 matingly interlock with ratchet teeth 68 and 69 on collars 64 and 65, respectively, and pull forward the roller 50. As roller 50 is pulled forward along support 11, it engages the rearwardmost end of the tube. The downward pressure exerted by the roller on the tube causes the contents to be dispensed through the nozzle. The second movement of the handle during each reciprocation is the return, upward movement which is assisted by the compression spring 28. As the handle begins its upward movement, the rails 42 and 43 begin moving slightly rearward. As described above, ratchet teeth 48 and 49 slide over the matingly engaged ratchet teeth 68 and 69, allowing the roller 50 to remain in its forwardmost position. Roller 50 remains stationary until handle 20 reaches a pre-determined point, illustrated in FIG. 4 by solid lines. Beyond this point, further rearward movement of rails 42 and 43 permits the roller 50 to move slightly rearwardly, relieving pressure on the tube, and preventing continued flow.

The rearward movement of the roller 50 during the over-center movement of the handle 20 is encouraged by the cooperation of two factors. First, as will be observed in FIG. 4, the surface of the support 11 on which the tube rests is angled very slightly upwards towards the wall 11A. This effectively reduces somewhat the distance between the axis of rotation of the roller 50 and the support 11 as the roller moves forward, increasing the pressure thereon. Secondly, movement of the handle 20 upwards beyond the pivot point into its over-center position causes the rails 42 and 43 to lift slightly. This slight lifting effect causes a gradual and partial disengagement of the surface of the roller 50 from the tube, decreasing frictional attraction between the roller and the tube and permitting the roller to move rearwardly with the rails, rather than the ratchets sliding over each other as occurs during the first portion of the reciprocatory cycle. As the roller 50 moves rearward, pressure is further relieved as the distance between the upper surface of support 11 and the axis of rotation of roller 50 increases. Of course, the precise degree to which the upper surface of the support 11 extends upwardly and the degree to which the arcuate movement of pin 45 causes a slight upwardly movement of the rails 42 and 43 can be readily understood in FIG. 4, but will vary depending on the overall size and scale of the dispenser.

The position of the handle 20 at the end of a reciprocating movement is shown in phantom lines in FIG. 4. The roller 50 is slightly rearward of its forwardmost position against the tube so that pressure is thereby relieved. If only slight pressure is desired against the tube so the flow therefrom is at a very low rate, the handle 20 may be moved downwardly to its centered position. Roller 50 will re-exert slight pressure on the tube but will not move forward a sufficient distance to cause a greatly increased flow from the tube. Successive reciprocating movements of the handle 20 cause incremental movement of the roller 50 forward against the tube, exerting continual pressure thereon. If a rapid series of reciprocating movements of the handle 20 is desired, the handle may be moved upwardly only to the pivot point illustrated in FIG. 4. Then on the last stroke when pressure is to be relieved from the tube, it may be moved upwardly into its over-center position, again illustrated in phantom lines in FIG. 4.

In the foregoing specification a tube dispenser is described which permits the progressive emptying of a tube by means of a simple mechanism which nevertheless permits the precise metering of the flow of contents from the tube so as to prevent residual emptying or dripping after each movement of the handle.

The drawings and specifications describe a preferred embodiment of the invention. Although specific terms are employed, they are employed in a generic and descriptive sense only and not for the purposes of limitation, the invention being defined by the claims.

I claim:

1. A tube dispenser for progressively emptying a tube from one end by applying pressure to the contents of the tube from the other end and comprising: p1 (a) a support for receiving and supporting a tube against longitudinal movement relative thereto;

(b) a handle pivotally mounted on said support and having a range of reciprocating movement between first and second pre-determined points for applying an increment of pressure to one end of the tube; and (c) ratchet means operatively connected to said handle and comprising a pair of parallel, spaced-apart and longitudinally extending elongate rails having a roller rotatably mounted transversely therebetween for limited movement from the closed end of the tube towards the open end of the tube, each of said rails being provided with teeth along one radially aligned surface thereof angled toward the direction of forward movement of said roller, and a pair of collars extending axially outwardly beyond the opposing end edges of said roller and having apertures therein for being slidably movable along said rails, and including means whereby during each reciprocation of said handle said roller is incrementally moved forward against said tube exerting pressure thereon and then maintained in said position during movement of said handle to a point defined relative to the pivot point of said handle on said support and beyond said pivot point to an over-center position where said roller releases sufficient pressure on the contents of the tube to prevent residual emptying or dripping thereof after each successive reciprocating movement of the handle thereby permitting a precisely metered flow of the contents from the tube.

2. A tube dispenser according to claim 1 and including biasing means for normally urging said handle to one extreme of the range of movement thereof.

3. A tube dispenser according to claim 1 wherein said ratchet means includes means for mounting said collars for axial movement relative to said roller, and biasing means interposed between said collars normally urging the collars outwardly against one of the pair of rails, each of said collars including a pawl for matingly engaging the teeth on said ratchet so as to permit movement of said roller on said longitudinally extending member in only one direction.

4. A tube dispenser according to claim 1 and including means for urging said roller against said support and a tube mounted therebetween.

* * * * *